US005147448A

United States Patent [19]

Roberts et al.

[11] Patent Number: 5,147,448

[45] Date of Patent: Sep. 15, 1992

[54] TECHNIQUES FOR PRODUCING FINE METAL POWDER

[75] Inventors: Peter R. Roberts, Groton; James E. Blout, Concord, both of Mass.

[73] Assignee: Nuclear Metals, Inc., Concord, Mass.

[21] Appl. No.: 591,284

[22] Filed: Oct. 1, 1990

[51] Int. Cl.[5] ..... B22F 9/00

[52] U.S. Cl. ..... 75/331; 75/338; 75/346; 264/9; 264/12

[58] Field of Search ..... 148/11.5 P; 75/331-346; 264/9, 12

[56] References Cited

U.S. PATENT DOCUMENTS

| | | | |
|---|---|---|---|
| 3,891,730 | 6/1975 | Wessel et al. | 75/337 |
| 4,124,377 | 11/1978 | Larson | 75/337 |
| 4,331,478 | 5/1982 | Ro et al. | 75/338 |
| 4,592,781 | 6/1986 | Cheney et al. | 75/343 |
| 4,671,906 | 6/1987 | Yasue et al. | 264/9 |
| 4,756,746 | 7/1988 | Kemp, Jr. et al. | 75/345 |
| 4,762,553 | 8/1988 | Savage et al. | 75/338 |
| 4,787,935 | 11/1988 | Eylon et al. | 75/338 |
| 4,824,478 | 4/1989 | Roberts et al. | 75/333 |
| 4,867,931 | 9/1989 | Cochran, Jr. | 75/338 |
| 4,988,464 | 1/1991 | Riley | 264/12 |

*Primary Examiner*—Upendra Roy
*Attorney, Agent, or Firm*—Iandiorio & Dingman

[57] ABSTRACT

Techniques for producing fine metal powder are described, including producing droplets of molten metal to be formed into a powder, providing an environment including a substance specifically introduced for combining with the droplets, and submitting the droplets to the environment for combining the introduced substance with the droplet metal to form at least a partial coating on the powder including the introduced substance.

23 Claims, 4 Drawing Sheets

TECHNIQUES FOR PRODUCING FINE METAL POWDER

FIELD OF INVENTION

This invention relates to a method and apparatus for producing fine metal powder and more particularly to techniques in which a reactive substance is used in forming and/or cooling molten metal droplets to alter the composition of the droplets as they solidify into powder particles.

BACKGROUND OF INVENTION

Fine metal powders, especially powders with diameters in the range of approximately 50 to 500 micrometers, are ideally suited for various powder metallurgical applications. Currently, there are many methods employed for producing these fine metal powders. A common powder generation process is gas atomization, in which a high velocity gas stream is employed to disintegrate a molten metal stream. Another technique, referred to as rotary atomization, involves pouring molten metal onto a spinning disk or cup which breaks up the stream and centrifugally ejects the metal as metal droplets; the droplets then solidify into spherical powder particles. Two other related techniques are the rotating electrode process and the plasma rotating electrode process, both of which employ a rotating consumable electrode which is melted with an arc or plasma arc, respectively. Molten metal droplets are flung from the electrode by centrifugal force and solidify as spherical powder particles.

In all of these powder formation techniques, a pure inert gas cooling atmosphere must be provided to produce the pure metal powders generally required for powder metallurgy; because of the high temperature and surface area of the molten metal drops, the drops are extremely prone to oxidation. A typical helium atmosphere must contain less than 10 ppm oxygen to prevent harmful formation of metal oxides.

As an example, in the production of extremely pure nickel-based super alloys such as Rene 95 and MERL 76, the helium comprising the inert cooling atmosphere must have no more than 0.5 ppm oxygen and a dew point of no greater than −100°F. to avoid the formation of oxide shells on the powder particles. If the oxide shells are allowed to form, the surface impurities lead to prior particle boundary decoration in the finished product when the powder is consolidated by hot isostatic pressing (HIP). If even small quantities of the impurities are present, the decorations, which may be carbides nucleated and precipitated at oxide particles, act as sites for fatigue failure. As an example, surface contamination must be avoided in the production by HIP of gas turbine disks designed to run at high rotation speeds, in order to avoid disk fatigue failure. The oxidation problem is also prominent in the production of titanium powders: titanium has a great affinity for oxygen, especially at the elevated temperatures required to produce the molten titanium droplets.

The pure spherical metal powders may be consolidated to form an elongated microstructure by the extrusion process; enhanced component strength may be obtained in the formed parts by the addition of other materials to form metal matrix composites. For example, silicon carbide fibers may be used in fabricating custom metal structures. In making these composites, the silicon carbide fibers may be co-extruded with pure metal powder to form the shapes.

SUMMARY OF INVENTION

It is therefore an object of this invention to provide a method and apparatus for producing in one step fine metal alloy powders.

It is a further object of this invention to provide a method and apparatus for producing fine metal powders having surface layers of different substances on the particles and/or strengthening phases as discrete deposits within the particles.

It is a further object of this invention to provide such an apparatus and method which may use any of the known powder-generation techniques.

It is a further object of this invention to provide such a method and apparatus in which the raw material for a metal matrix composite may be manufactured in a single step.

This invention results from the realization that fine metal powders may be manufactured in a single step by adding to the powder-cooling and usually chemically protective atmosphere a substance which reacts with the metal from which the powder is formed. In this way new and special forms of powder may be generated.

This invention features a method of producing fine metal powder particles including producing droplets of molten metal to be formed into a powder, providing an environment including a substance specifically introduced for combining with the droplets, and submitting the droplets to the environment for combining the introduced substance with the droplet metal to form at least a partial coating including at least part of the introduced substance on the powder. The droplets may be produced by atomizing molten metal or centrifugally forming droplets by a number of techniques for producing extremely fine metal powders. The step of atomizing molten metal may include impinging a gas stream on the molten metal to break it into droplets. In that case, the gas stream may include the introduced substance for reacting with the droplet metal on droplet formation.

In centrifugally forming the droplets, the droplets may be created from a rotating bar including the metal to be melted. The metal may be melted by providing an electric arc or a plasma arc to the metallic electrode. The substance may be introduced into the arc to begin reaction with the droplet metal as the droplets are formed. Other centrifugal powder formation techniques include melting a rotating metal disc, and breaking a molten metal stream into droplets with a rotating inert member.

The environment may include a gaseous atmosphere, in which the introduced substance may be at least a part of the atmosphere. The environment may alternatively or further include a liquid such as a liquefied gas medium. In that case, the introduced substance may be at least part of the liquid medium. The reactive atmosphere may include an aerosol of finely divided solid material for reacting and/or depositing on the surface of the metal particles. The introduced substance may alternatively alloy with the droplet metal, for example nitrogen for alloying with titanium.

This invention also features a method for producing fine metal alloy powder including rotating at a high rate of speed an at least partly consumable cylinder including the metal to be powdered, surrounding the distal end of the cylinder with a gaseous atmosphere including a reactive substance, and heating the distal end of the rotating cylinder to melt the metal and fling from the cylinder into the atmosphere molten metal droplets to simultaneously react or alloy the droplet metal, and at least partially cool the droplets to form the reacted or alloyed powder.

This invention also contemplates producing fine reacted metal powder by providing a gaseous atmosphere including a reactive substance, forming at a location within the atmosphere molten metal droplets, and urging the droplets away from the location into the atmosphere to at least partly react and cool the droplets for forming the reacted powder. Further contemplated is a method for producing coated fine metal powder particles including producing droplets of a molten metal to be formed into a powder, providing a liquid medium including a substance specifically introduced for reacting with a metal, and submitting the droplets to the liquid medium to form at least a partial coating including the reactive substance on the powder.

An apparatus for producing fine reacted metal powder according to this invention may include means for providing a gaseous atmosphere including a reactive substance, means for forming at a location within the atmosphere molten metal droplets, and means for urging the droplets away from the location into the atmosphere to at least partly react and cool the droplets for forming the reacted powder. Preferably, the reactive substance includes a substance for alloying the droplet metal.

DISCLOSURE OF PREFERRED EMBODIMENT

Other objects, features and advantages will occur to those skilled in the art from the following description of a preferred embodiment and the accompanying drawings, in which.

Figure 1A:
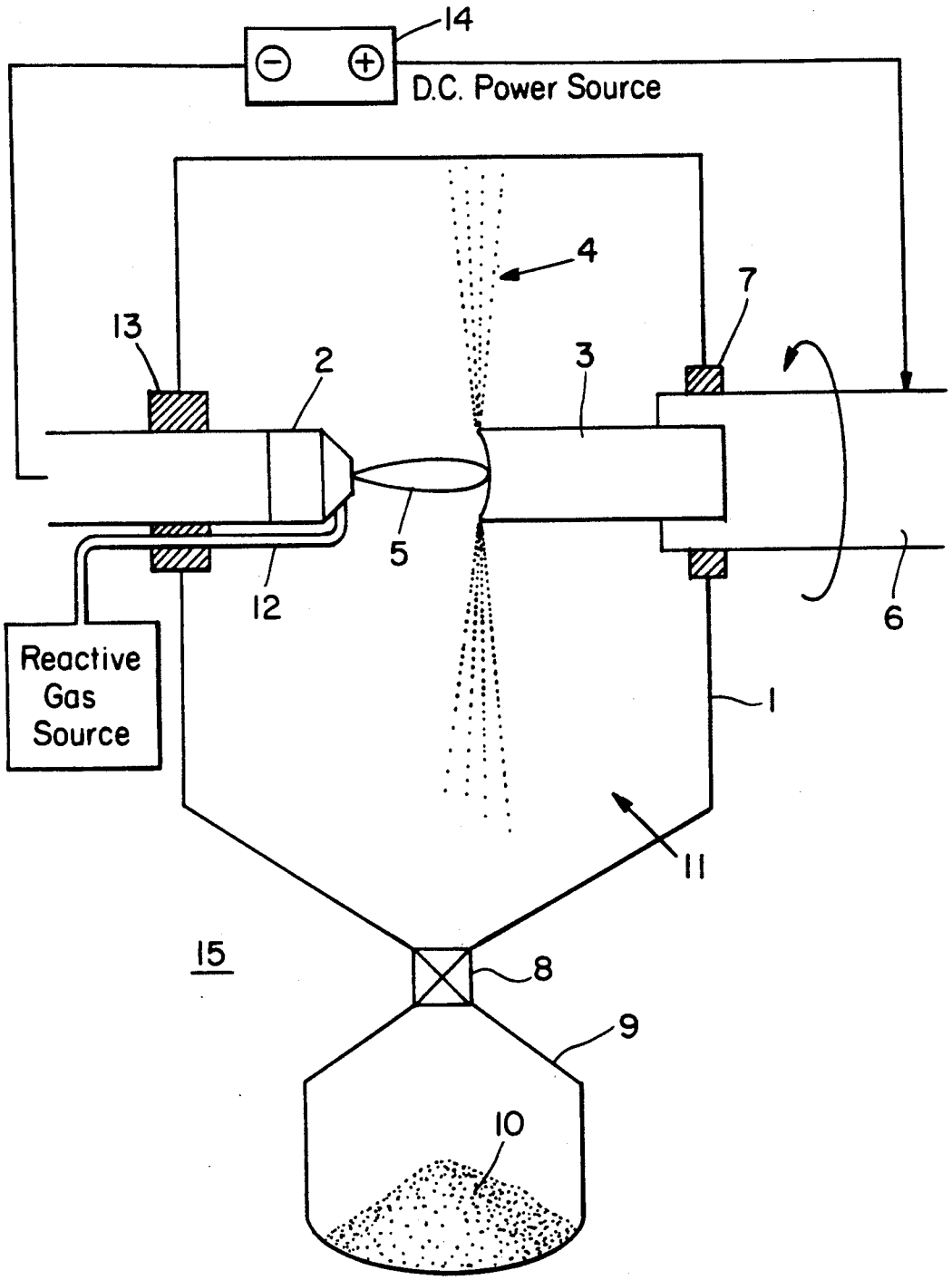
FIG. 1A is a schematic, partly cross-sectional view of a plasma rotating electrode process apparatus for producing fine metal powder and practicing the method according to this invention.

In the manufacture of metal powders such as titanium alloy powders, a new technique, which may be termed reactive atomization, has been devised where the strengthening agent is introduced during the plasma rotating electrode atomization process. However, the method need not be restricted to this process, and may be applied to other processes such as rotary atomization and gas atomization. In some instances the amount of reaction is minimal while in others chemical reaction between the principal material and the agent added to provide the reinforcement material is extensive.

Illustratively, when atomizing titanium by the plasma rotating electrode process, it has been found useful to introduce controlled amounts of nitrogen into the helium gas passing through the plasma torch. Fine, hard particles are formed in an even dispersion within the powder particles. When CPTi, Grade II electrodes (a pure form of titanium having 0.25% oxygen, maximum) were converted to powder this way and the powder was then consolidated by hot extrusion, the ultimate tensile strength and the yield strength were increased by 45% and 60% respectively over those properties exhibited by a control sample that had not received such a nitrogen injection.

Titanium powder produced when the helium cover gas in the powdering vessel is adulterated with nitrogen has a reacted layer on the surface of the particles so that they vary in color from brown to light yellow. These powders when extruded also exhibit a higher strength than material produced in a pure helium atmosphere.

These examples illustrate the principle that a useful effect can be achieved by adjustment of the atmosphere composition either in the plasma torch or the tank cover gas during the generation of metal powders. The method is ideally suited to the plasma rotating electrode process generation of titanium alloy powders, but it need not be restricted to either the process or the material. The interaction of molten titanium with nitrogen is complex and has been the source of considerable study by aircraft engine companies. Nitrogen additions can form alpha stabilized nitrided titanium particles which will survive multiple melting operations and will not decompose. The composition of the nitrided material is variable and may contain up to 15–20 weight percent (approximately 35–45 atomic percent) nitrogen although lower quantities may also be involved.

Titanium alloys containing hard alpha stabilized particles formed by nitrogen will not be suitable for certain applications where resistance to fatigue is a dominant requirement. The applications of most interest will be those where high tensile stress with a modest level of ductility are useful, as for example in high strength fasteners.

As stated previously the principle is not restricted to a single process or combination of materials. It relates to the manufacture of metal powders which contain a phase or phases within them or which have a surface coating or which possess both features as a result of the interaction of the metal being powdered with the atmosphere or gas used in the powdering process. In addition, the introduced substance may form new phases, precipitates, or structures that are quenched in by the rapid solidification available from atomization. For most applications it is anticipated that the powders will be consolidated by Hot Isostatic Pressing, Rapid Omnidirectional Compaction, extrusion or other methods, and the consolidated material will become a metal matrix composite by virtue of the phases formed on and in the component powder particles. Alternatively, the loose powders themselves may be used for their enhanced properties. For example, surface-hardened metal powders fabricated by these techniques may be useful for specialized shot-peening.

The reacted phase or phases may comprise fine dispersions or precipitates, or may be more coarse and ductile so that they string out when deformed, and therefore act as a fiber reinforcement. This one-step technique of forming the fibers or reinforcements at the same time as the powder is produced will result in composite reinforcing phases that may have greatly improved interface bonding when compared to such composites produced by a two-step process.

The reacted or deposited strengthening phase may form a brittle shell on the metal particles, which would break up into reinforcing particles when consolidated. The reinforcing layer or shell may also be made relatively thick to provide a substantial quantity of the reacted or deposited material. These particles may then be blended with unreacted particles to form composite structures tailored to a particular application.

The methods used to make metal powders could include gas atomization, rotary atomization by disc or cup as well as rotating electrode process and plasma rotating electrode process.

The materials used to interact with the pulverized metal can include at least the following chemicals and forms:

$CH_4$ (or other suitable hydrocarbon) in He to form carbides eg., TiC.

Hydrocarbon/$N_2$ mixtures or $C_xH_yN_z$ compound vapors in He to form carbo-nitrides such as Ti(C,N).

Boron hydrides ($B_2H_6$, $B_4H_{10}$) in He to form $TiB_2$.

Organo-metallic vapors in He to form alloy layers, eg., $Al(CH_3)_3$ vapor in He to form Ti-Al alloys on Ti particles.

$Ni(CO)_4$ vapor in He to form Ni layers on various metal particles.

Aerosol suspensions of very fine solids entrained in He. These solids may be substantially finer in size than the molten metal droplets that are formed and may become incorporated within the solidified powder particles.

Oxygen mixed with the helium arc transport gas passed through the plasma torch arc during the generation of beryllium powder to obtain fine dispersions of BeO in Be.

Many other doping systems to provide usefully coated powders, powders containing dispersoids or both of these features will occur to those skilled in the art.

This invention may be accomplished in a method and apparatus for producing fine metal powder particles including at least two substances. The substances are typically the metal substance melted to form the powder particles, and a surface layer and/or fine dispersions or precipitates of either an alloy of that metal substance or a different substance introduced into the atomization process or quenching atmosphere.

FIG. 1A illustrates apparatus 15 according to this invention for making powder from metal electrode 3 by the plasma rotating electrode process. Plasma torch 2 is a transferred arc torch containing a cathode, and rotating electrode 3 acts as the anode. D.C. power source 14 supplies the power for generating arc plume 5. Electrode holder 6 is rotated as shown by the arrow to fling molten metal melted by arc plume 5 off as droplets 4. Seals 7 and 13 prevent gas and powder escape from containment vessel 1. Valve 8 leads to powder collection vessel 9 for collecting solidified powder 10.

Atmosphere 11 within main tank 1, also called the cover gas, cools droplets 4. Atmosphere 11 may contain a reactive gas or gases, or an aerosol, to accomplish the reacted and/or coated particles. Alternatively, or additionally, supplementary reactive plasma torch gas feed tube 12 may supply a reactive component to torch 2. In this case, the component is ionized in arc plume 5; the high energy state increases the component reactivity and may provide additional element injection into the molten metal.

Figure 1B:
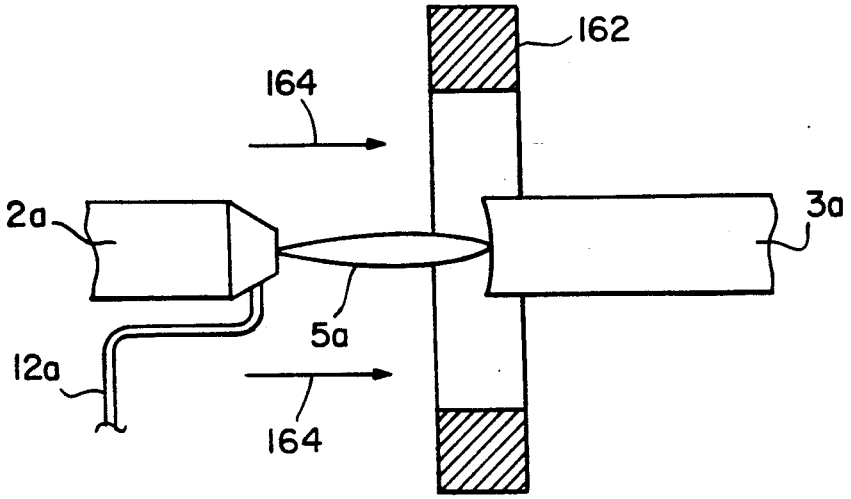
FIG. 1B is an alternative to FIG. 1A employing an ion-accelerating magnetic field.

FIG. 1B illustrates an alternative arrangement to that of FIG. 1A in which annular magnet 162, shown in section, or another source of magnetic or electromagnetic energy is employed to provide a reactive ion accelerating field between torch 2a and electrode 3a, illustrated by arrows 164. The reactive gas ions in plume 5a can be accelerated, focused and/or attracted toward target 3a by field 164. By judicious choice of the reactive additive, using the acceleration field the properties of the composite, or of the metal powder surface, may thus be enhanced. For example, the additional energy from field 164 provides the ability to inject elements into the target even though the added material(s) normally do not alloy or form compounds with the material of electrode 3a.

Another way of supplying a material to the atomized target is to allow the electrode contained within the plasma torch 2a to be consumed. This could provide materials which are not available in a gas, which is supplied through tube 12a.

Figure 1C:
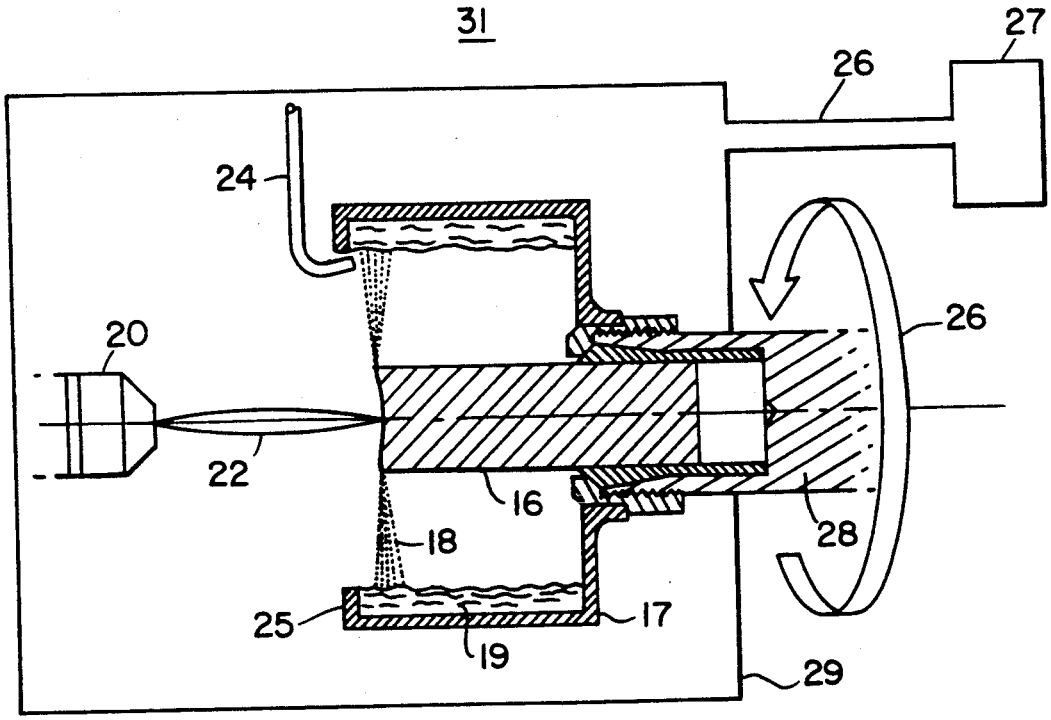
FIG. 1C is a simplified schematic diagram of an alternative to FIG. 1A in which the reactive material is in the liquid state as for instance, liquid methane or a mixture of liquid methane with liquid argon.

There is shown in FIG. 1C alternative metal powder producing apparatus 31 according to this invention. Apparatus 31 is a rotating electrode powder-forming apparatus which employs a permanent cathode held within the plasma torch 20 and cylindrical bar 16 of the metal to be powdered as the anode. Transferred electric arc 22 melts the face of electrode 16, which is rotated in the direction of arrow 26 by means, not shown, attached to shaft 28. Open-ended drum 17 completely surrounds electrode 16 and is also rotated through shaft 28.

As electrode 16 melts, its rotation flings molten metal droplets 18 into drum 17. In this embodiment, liquid quench medium 19, which may be liquefied gas, is added to drum 17 through conduit 24 and held in place by lip 25 to create an annulus of extremely cold liquid for quenching and fully solidifying droplets 18 to form the powder. In prior powder formation techniques, liquid 19 has been a liquefied inert gas such as argon to ensure absolute powder purity.

With proper selection of the quenching atmosphere, the liquid quench medium, and/or the component introduced into the plasma arc, the properties of the powder produced by apparatus 31 may be altered as desired. The choice of liquefied gas medium 19 may also affect the properties of the metal powder; the liquid contributes to the gaseous cooling atmosphere and also is the medium in which particles 18 are fully hardened. Generally, liquefied gas 19 and/or the cover gas includes an inert gas such as argon but it may be liquid argon mixed with a desired reactive material or a liquefied reactive gas on its own chosen to formulate a desired end product.

Thus, by proper selection of medium 19 and control of tank temperature by controller 27, quench medium 19 may be employed to supply at least part of the desired atmosphere. For example, medium 19 may be argon. By maintaining the temperature above the argon boiling point, an argon atmosphere will be created surrounding electrode 16. In that case, the added component may be separately supplied to properly dope the atmosphere. Alternatively, medium 19 could include a liquefied reactive substance which contributes the reactive substance to both the atmosphere and the quench medium for both reacting and cooling the molten metal droplets.

It is thus within the scope of this invention to employ gases, aerosol suspensions, and/or liquefied gas mediums to at least partly cool and solidify and at the same time alloy or coat the pure metal droplets flung from electrode 16. Typically, the reaction product or coating layer would form and remain at the particle surface. However, sub-surface features may be obtained due to enfolding caused by turbulence during cooling. In any case, the result is a fine metal powder including at least a partial coating with the introduced, reactive substance either in the form of an alloy, an alloy-coated metal particle, or a metal particle coated by a second substance which may include a metal substance.

On completion of the powder-formation operation, liquefied gas medium 19 is evaporated to leave behind the fine powder particles. Enclosure 29 connected to temperature controller 27 by conduit 26 may be employed to evaporate medium 19. In the use of liquefied gases, it is only necessary to allow the apparatus to stand at room temperature to evaporate medium 19 and leave behind unentrained powder which can simply be poured from drum 17.

Figure 2:
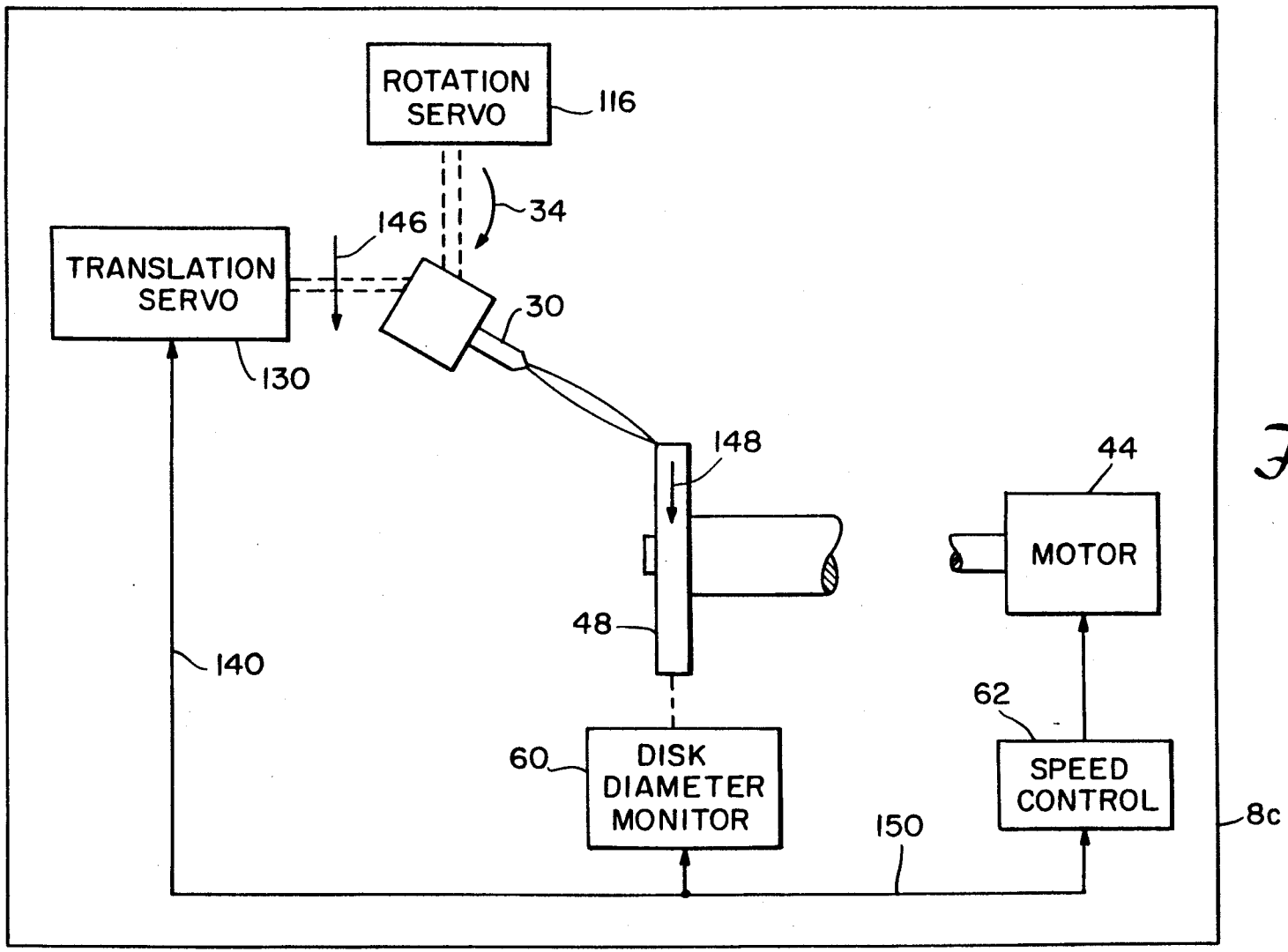
FIG. 2 is a simplified schematic diagram of a rotating disk electrode apparatus in which the usual right cylindrical electrode is replaced by a flat circular plate consumed from the edge inwards and is an alternative to the apparatus of FIG. 1A.
Figure 4:
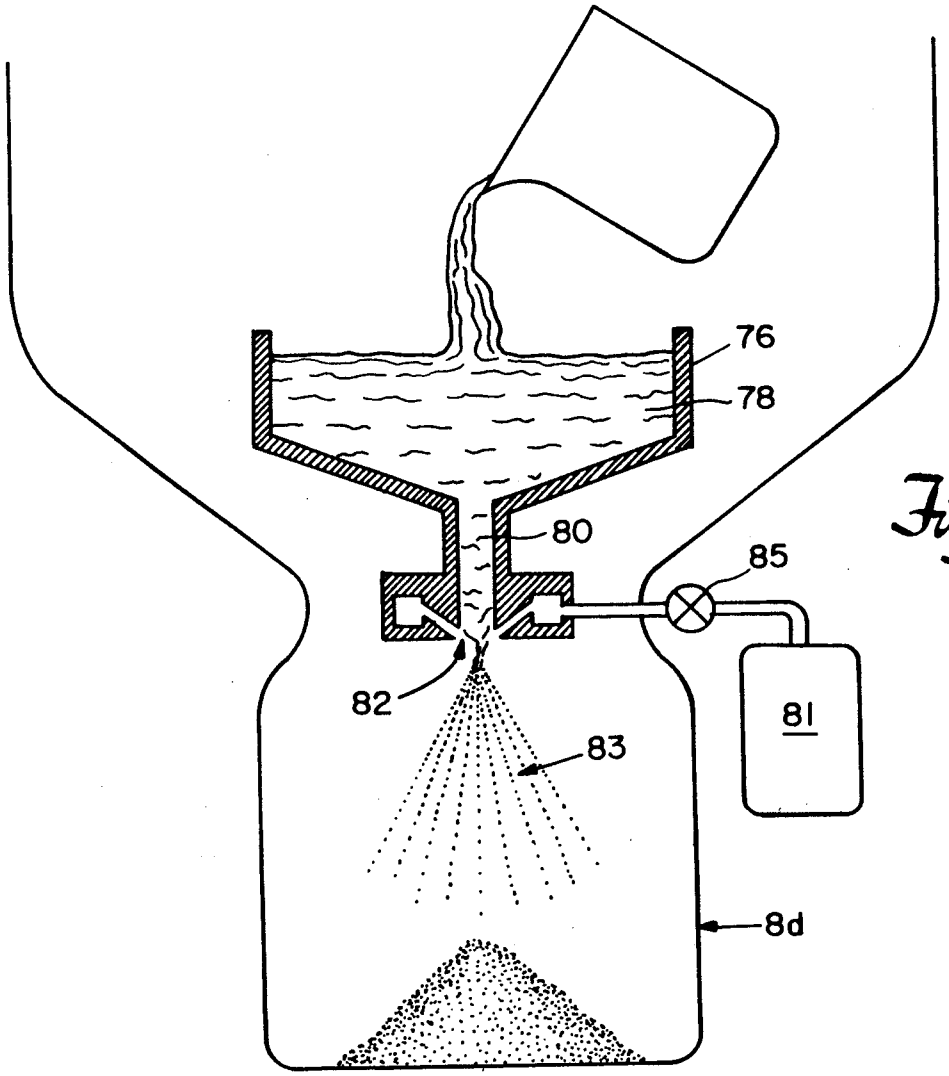
FIG. 4 is a simplified schematic diagram of a gas atomization apparatus alternative to the apparatus of FIG. 1A.
Figure 3:
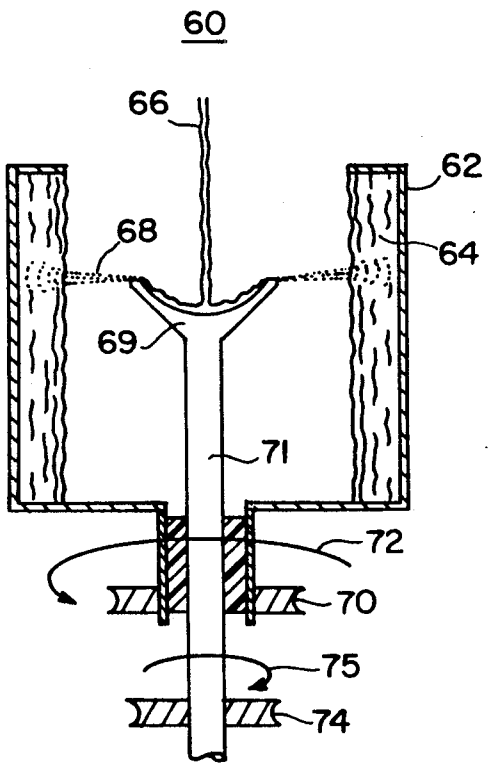
FIG. 3 is a schematic diagram of a disk atomization apparatus alternative to the apparatus of FIG. 1A where the cup shaped disc is not consumed but is rotated to centrifugally expel molten metal that is poured onto it.

FIGS. 2, 3 and 4 illustrate additional embodiments of the method and apparatus of this invention. In FIG. 2, disk-shaped electrode 48 of the metal to be powdered is rotated by motor 44 in the direction of arrow 148. Plasma or arc source 30 is directed to the edge of disc 48 to melt the face of that edge; the melt is centrifugally ejected from disc 48 to form molten droplets which are then reacted/coated as described.

To maintain a relatively constant particle size, the centrifugal ejecting force on molten droplets at the contracting rim of disc 48 must be held constant throughout the operation. To accomplish this, disc diameter monitor 60 passes a signal representative of the disc diameter to speed control 62 and translation servo 130. Speed control 62 causes motor 44 to speed rotation of electrode 48 to maintain a constant centrifugal force which is a function of the electrode diameter and the square of the rotation rate at any given instant. Translation servo 130 drives plasma or arc apparatus 30 in the direction of arrow 146 as the disc melts to maintain the proper spacing to ensure the proper heating and melting of the disc. An alternative to translation servo 130 is rotation servo 116, which may be employed with a translationally fixed melting apparatus which is simply rotated in the direction of arrow 34 as the disc melts to continuously aim the arc or plasma plume at the edge of the disc to ensure continued edge melting as the disc diameter changes.

Yet another powder-formation technique is illustrated schematically in FIG. 3. Apparatus 60 employs inert rotating cup or disc 69 to break molten metal stream 66 into droplets 68, which are reacted and solidified as described above. In this example, vertically oriented annulus 64 of liquefied gas is employed to fully harden droplets 68. Also illustrated is the counter-rotation of the droplet source and liquid annulus which provides for the formation of finer powders as is known in the art. Drum 62 is rotated in the direction of arrow 72 through pulley 70; shaft 71 is rotated in the direction of arrow 75 through pulley 74.

Perhaps the most common powder generation process is the gas atomization process illustrated schematically in FIG. 4. High pressure gas source 81 controlled by valve 85 is supplied to delivery annulus 82, where it is directed toward liquid metal stream 80 to break stream 80 into droplets 83. Container 76 for molten metal reservoir 78 supplies the molten metal to be atomized. Typically, the high velocity gas disintegrating medium for making clean metal powders has been argon. The gas atomization process according to this invention employs an atomizing gas medium which may include any of the gases and/or aerosol mediums described above as both the disintegrating and reacting medium. Alternatively or additionally, the atmosphere within enclosure **8*d*** may be doped with a reacting medium or inert gas/reacting medium mixture, such as argon and methane for creating powder surface layers or dispersions of carbides.

Although a number of powder-generation techniques have been described, each of the techniques may be employed to generate fine metal powder particles at least partly coated with a reacted or deposited layer. A specific example of the powder particles which may be produced by the method and apparatus according to this invention involves the generation of titanium powder in a helium atmosphere to which a measured quantity of nitrogen has been added. Powder particles are produced which have a reacted surface layer of titanium nitride. When this powder is consolidated by extrusion, an even distribution of titanium nitride is disposed throughout the solid material, providing a strengthening or reinforcing phase which increases the tensile strength as compared to a pure titanium extrusion. It has been found that the surface layers form elongated titanium nitride fibers in the extruded product. To create a finely dispersed titanium nitride reinforcing phase, the apparatus of FIG. 1A or 1B, which injects highly reactive, ionized nitrogen at extremely high temperatures into the titanium melt, would likely create the titanium particles with fine dispersions of titanium nitride needed to provide the fine dispersions in the extruded product.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A method of producing fine metal powder particles, comprising:

producing droplets of molten metal to be formed into a powder;

providing an environment including a substance specifically introduced for combining with said droplets; and submitting said droplets to said environment for combining said introduced substance with the droplet metal to form at least a partial coating including at least part of said introduced substance on said powder particles.

2. The method of claim 1 in which producing droplets includes atomizing molten metal.

3. The method of claim 1 in which producing droplets includes centrifugally forming droplets.

4. The method of claim 1 in which the environment includes a gaseous atmosphere.

5. The method of claim 1 in which the environment includes a liquid medium.

6. The method of claim 1 in which said introduced substance includes a substance for alloying the droplet metal.

7. The method of claim 2 in which atomizing molten metal includes impinging a gas stream on the molten metal to break it into droplets.

8. The method of claim 3 in which centrifugally forming droplets includes providing a rotating bar including the metal to be melted.

9. The method of claim 3 in which centrifugally forming droplets includes melting a rotating metal disc.

10. The method of claim 3 in which centrifugally forming droplets includes breaking a molten metal stream into droplets.

11. The method of claim 4 in which said introduced substance is at least part of the atmosphere.

12. The method of claim 4 in which said introduced substance includes an aerosol of finely divided solid material.

13. The method of claim 5 in which the liquid medium includes a liquefied gas.

14. The method of claim 7 in which said gas stream includes said introduced substance for combining with the droplet metal on droplet formation.

15. The method of claim 8 in which centrifugally forming droplets further includes melting the metal in said rotating bar.

16. The method of claim 10 in which a rotating member breaks said stream into droplets and projects them away to solidify.

17. The method of claim 13 in which said introduced substance is at least part of said liquefied gas medium.

18. The method of claim 15 in which melting the metal in said rotating bar includes providing a high energy arc to melt said metal.

19. The method of claim 18 in which melting the metal in the rotating bar further includes introducing said introduced substance into the arc to begin reaction with said droplet metal as the droplets are formed.

20. The method of claim 18 in which said arc is provided directly to said rotating bar.

21. A method for producing fine metal powder, comprising:

rotating at a high rate of speed an at least partly consumable cylinder including the metal to be powdered;

surrounding the distal end of said cylinder with a gaseous atmosphere including a reactive substance; and heating said distal end of said rotating cylinder to melt the metal and fling from said cylinder into the atmosphere molten metal droplets to simultaneously cool and alter the composition of the droplets.

22. A method for producing fine reacted metal powder, comprising:

providing a gaseous atmosphere including a reactive substance;

forming at a location within the atmosphere molten metal droplets; and urging said droplets away from the location into said atmosphere to at least partly react and cool said droplets for forming the reacted powder.

23. A method for producing coated fine metal powder particles, comprising:

producing droplets of a molten metal to be formed into a powder;

providing a liquid medium including a substance specifically introduced for reacting with said metal; and submitting said droplets to said liquid medium to harden said droplets and form at least a partial coating including said substance on said powder.

* * * * *